US006067692A

United States Patent [19]

Chang

[11] Patent Number: 6,067,692

[45] Date of Patent: May 30, 2000

[54] MICRO-ADJUSTABLE BELT STRUCTURE

[76] Inventor: Chih-Wen Chang, Chiu-Chuang St., Taipei, Taiwan

[21] Appl. No.: 09/386,469

[22] Filed: Aug. 31, 1999

[51] Int. Cl.[7] ..... A44B 11/04; A44B 11/20

[52] U.S. Cl. ..... 24/303; 20/265 BC; 20/316; 20/163 R

[58] Field of Search ..... 24/163 K, 163 R, 24/303, 365 BC, 308, 309, 173, 580, 460; 2/312, 322

[56] References Cited

U.S. PATENT DOCUMENTS

| | | | |
|---|---|---|---|
| 2,867,023 | 1/1959 | Putnam | 24/303 X |
| 3,030,680 | 4/1962 | Wilhelm | 24/303 |
| 3,063,118 | 11/1962 | Salter et al. | 24/163 R |
| 3,293,714 | 12/1966 | Shafer | 24/303 |
| 5,323,516 | 6/1994 | Hartmann | 24/303 |
| 5,673,463 | 10/1997 | Chih-wen | 24/265 BC |

FOREIGN PATENT DOCUMENTS

| | | | |
|---|---|---|---|
| 690115 | 6/1964 | United Kingdom | 24/303 |

*Primary Examiner*—James R. Brittain
*Assistant Examiner*—Robert J. Sandy
*Attorney, Agent, or Firm*—Dougherty & Troxell

[57] ABSTRACT

A micro-adjustable belt structure including a belt head, a micro-adjusting strap, a micro-adjuster and a clip buckle. The micro-adjuster is formed with a dent in which a magnet is fixedly disposed. The clip buckle is also formed with a dent in which a magnetic member such as an iron plate is fixedly disposed corresponding to the magnet. The clip buckle is made of a non-magnetic material. The magnetic member is covered by a protective film for protecting the magnetic member from being rusted. The magnet and the magnetic member attract each other to attach the micro-adjuster and the clip buckle to each other.

7 Claims, 4 Drawing Sheets

MICRO-ADJUSTABLE BELT STRUCTURE

BACKGROUND OF THE INVENTION

The present invention relates to a micro-adjustable belt structure in which a magnet is disposed on the belt head and an iron plate is disposed on a clip buckle corresponding to the magnet. The magnet and the magnetic member attract each other to quickly assemble the belt head with the clip buckle to form an integral structure. The belt head can be detached from the clip buckle with a finger by little strength for micro-adjustment.

FIG. 1 shows a conventional micro-adjustable belt structure including a belt head, a micro-adjusting strap, a micro-adjuster and a clip buckle. When the micro-adjuster is not separated from the clip buckle (not micro-adjusted), the micro-adjuster must be tightly bound with the belt head to achieve an integral appearance. When it is desired to micro-adjust the belt (the clip buckle is separated from the micro-adjuster), the clip buckle must be easily detached from the micro-adjuster with a finger by little strength for micro-adjustment. In assembling, the components of the belt head are generally connected with each other by means of pivots or screws. Once it is necessary for a user to adjust the belt, it is troublesome to disassemble and assemble these components.

SUMMARY OF THE INVENTION

It is therefore a primary object of the present invention to provide a micro-adjustable belt structure in which a magnet is disposed on the micro-adjuster and an iron plate is disposed on a clip buckle corresponding to the magnet. The magnet and the magnetic member attract each other to quickly assemble the belt head with the clip buckle and the micro-adjuster to form an integral structure. When micro-adjusted (when drawing the clip buckle from the micro-adjuster), a user only needs to directly draw away the magnet and, the iron plate laterally. It is unnecessary to apply a great strength onto the clip buckle. Therefore, the belt head can be detached from the clip buckle very easily and quickly.

It is a further object of the present invention to provide the above micro-adjustable belt structure in which the iron plate is disposed with a hidden trademark which highlights the style of the belt without occupying room. In addition, after the belt is fastened, the micro-adjuster is right positioned at the vital points of the abdomen of the user. By means of the magnetic massaging effect, the vital points can be massaged and the blood circulation can be enhanced.

According to the above objects, the micro-adjustable belt structure of the present invention includes a belt head, a micro-adjusting strap, a micro-adjuster and a clip buckle. The micro-adjuster is formed with a first dent in which a magnet is fixedly disposed. The clip buckle is formed with a second dent in which a magnetic member is fixedly disposed corresponding to the magnet. The clip buckle is made of a non-magnetic material. The magnetic member is covered by a protective film for protecting the magnetic member from being rusted. The magnet and the magnetic member attract each other to attach the micro-adjuster and the clip buckle to each other.

The present invention can be best understood through the following description and accompanying drawings wherein:

DETAILED DESCRIPTION OF THE PREFERRED EMBODIMENTS

Figure 2:
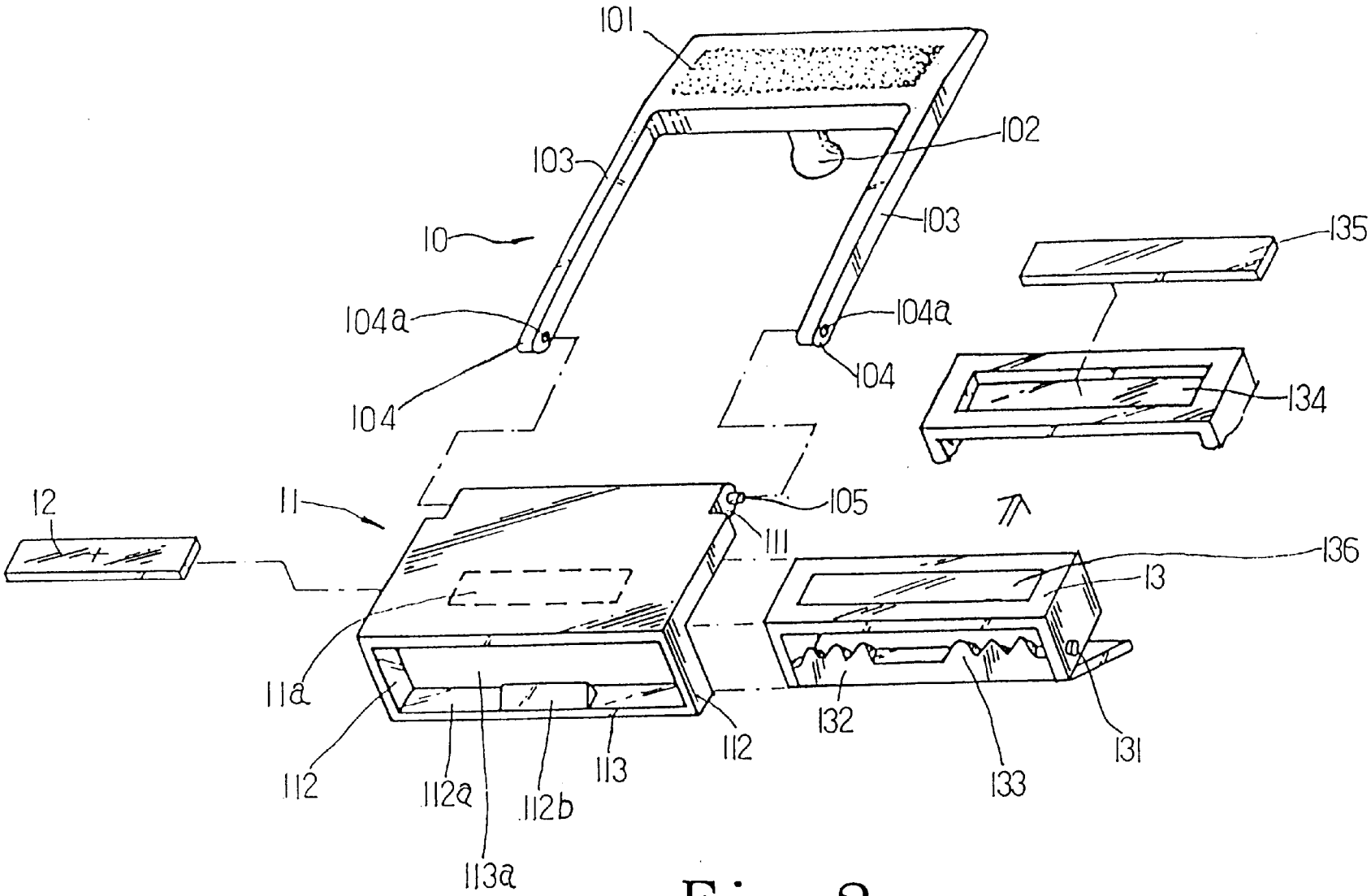
FIG. 2 is a perspective exploded view of a first embodiment of the present invention.
Figure 3:
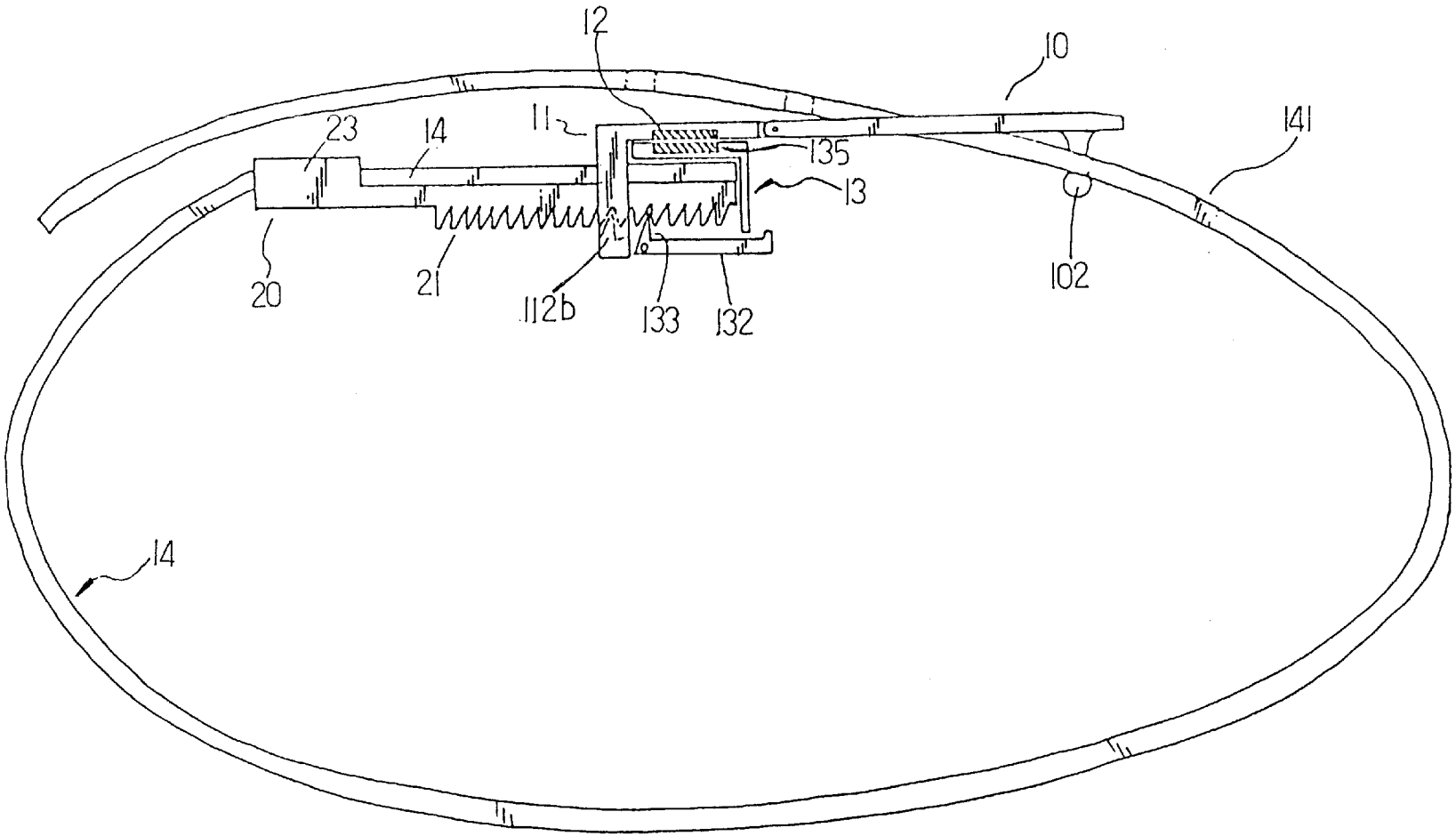
FIG. 3 is a side sectional view of the first embodiment of the present invention.

Please refer to FIG. 2. The micro-adjustable belt of the present invention includes a belt head 10, a micro-adjusting strap 20, a micro-adjuster 11 and a clip buckle 13.

The belt head 10 is substantially U-shaped, having a latch board 101. A mushroom-shaped restricting latch 102 is disposed on lower side of the latch board 101 for fitting into a restricting perforation 141 of the belt 14. The belt head 10 further has two fixing bars 103 extending from two sides of the latch board 101. A free end 104 of each fixing bar 103 is formed with an orifice 104*a* in which a short post 105 at each end of the micro-adjuster 11 is fitted, whereby the belt head 10 can be freely swung.

Two ends of one side of the micro-adjuster 11 are respectively formed with two cuts 111. The short post 105 outward projects from the lateral wall of the cut 111. Two ends of the other side of the micro-adjuster 11 are respectively disposed with two downward extending short bars 112. A bridge bar 112*a* is connected between the front ends of the two short bars 112 to form a frame body 113 defining a central opening 113*a* for the clip buckle 13 to fit therein. The upper edge of the bridge bar 112*a* is formed with an engaging block 112*b* for engaging with projecting teeth 21 of the micro-adjusting strap 20. The surface of the lower edge of the micro-adjuster 11 is recessed to form a first dent 11*a* in which a magnet 12 is fixed for attracting an iron plate 135.

Figure 1:
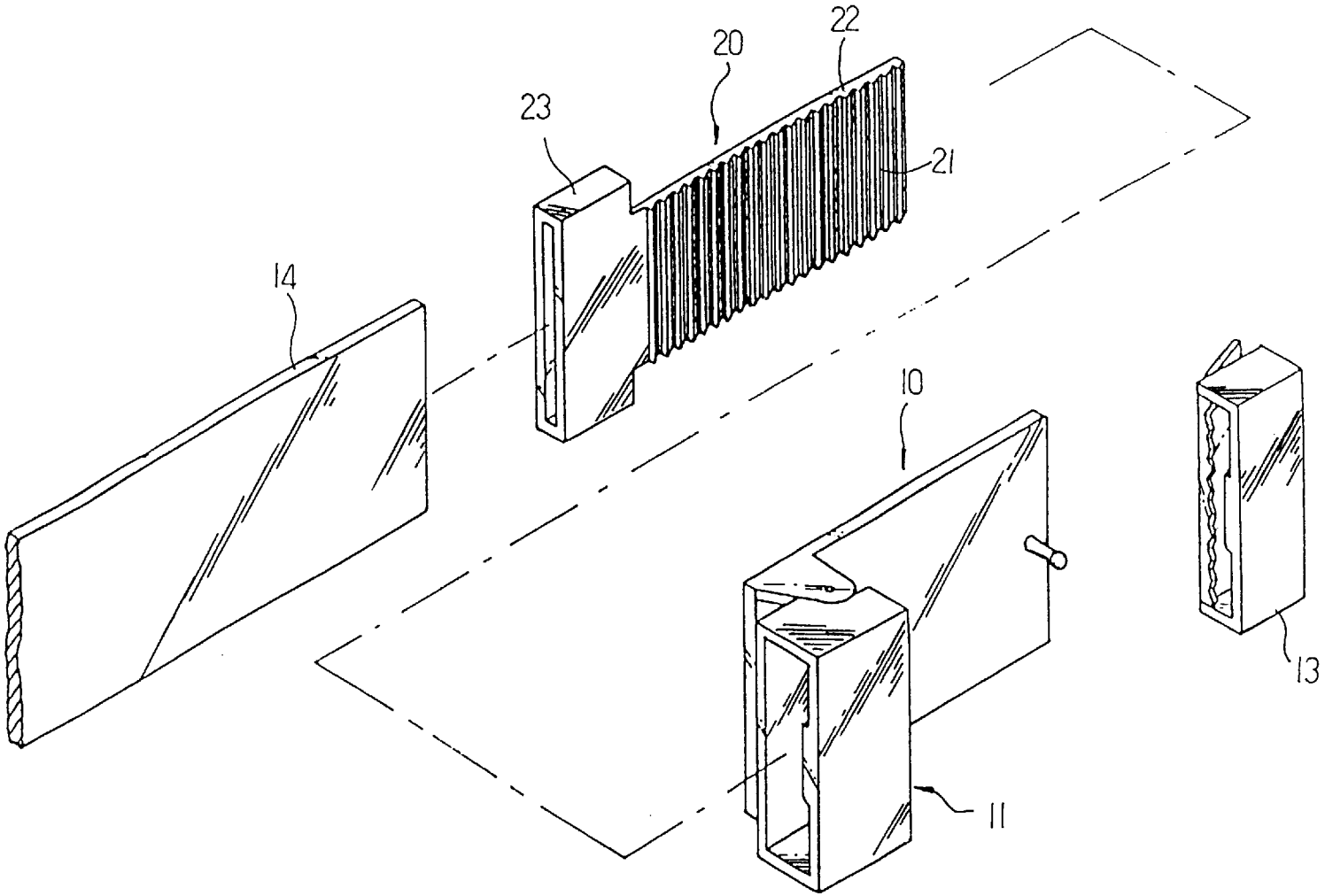
Fig. 1 (Prior Art)
FIG. 1 is a perspective exploded view of a conventional micro-adjustable belt.

Referring to FIG. 1, the micro-adjusting strap 20 is a toothed strap 22 formed with a row of inclined saw teeth 21. The fixing head 23 of the front end of the micro-adjusting strap 20 is fitted with an inner side of the belt 14. The clip buckle 13 locks the rear end of the micro-adjusting strap 20 with the belt 14.

The clip buckle 13 is made of a certain material (such as zinc alloy). The lower sides of two ends of the clip buckle 13 are respectively formed with two pivot holes 131. A pivot 131*a* is fitted into the pivot holes 131 and two pivot holes 132*a* formed on two ends of a movable clipping plate 132 to pivotally connect the clipping plate 132 with the clip buckle 13. The upper edge of the movable clipping plate 132 is formed with multiple biting teeth 133 for tightly biting and binding the belt 14 with the micro-adjusting strap 20. The surface of the upper edge of the clip buckle 13 is recessed to form a second dent 134. An iron plate 135 is placed in the second dent 134 and covered by a transparent protective film 136 for protecting the iron plate 135 from being rusted. In the case that the clip buckle 13 is entirely made of iron material, the iron plate 135 can be omitted.

Accordingly, the magnet 12 of the micro-adjuster 11 attracts the iron plate 135 of the clip buckle 13 to achieve the following advantages:

1a. The clip buckle 13 and the micro-adjuster 11 magnetically attract and attach to each other and tightly bind with the belt head to achieve an integral structure.

2a. When drawing the clip buckle 13 from the micro-adjuster 11 (for micro-adjustment), a user only needs to directly separate the magnet 12 from the iron plate 135. Such operation can be conveniently and quickly performed and it is unnecessary to apply a great force onto the clip buckle 13.

Figure 4:
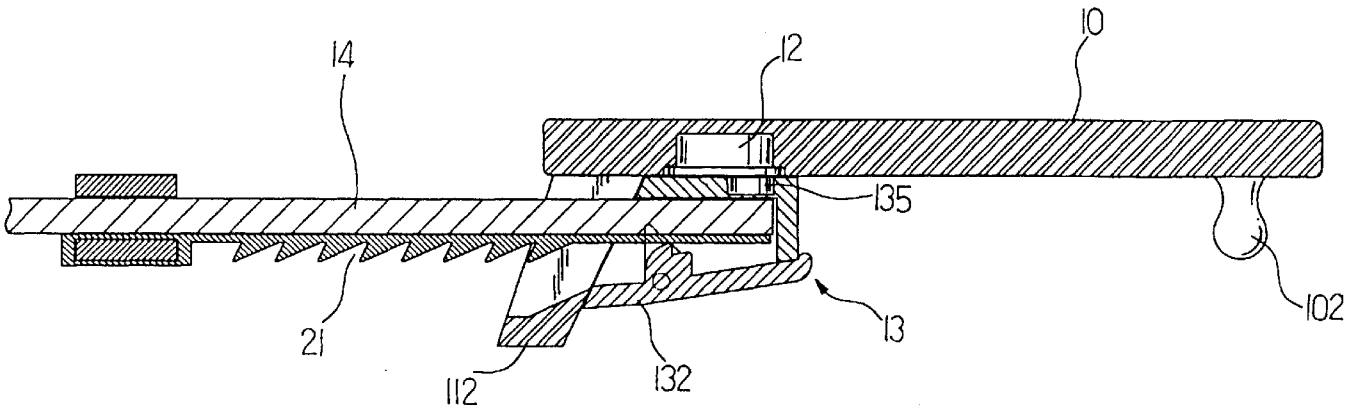
FIG. 4 is a sectional view showing that the other end of the belt is inserted into the present invention.
Figure 5:
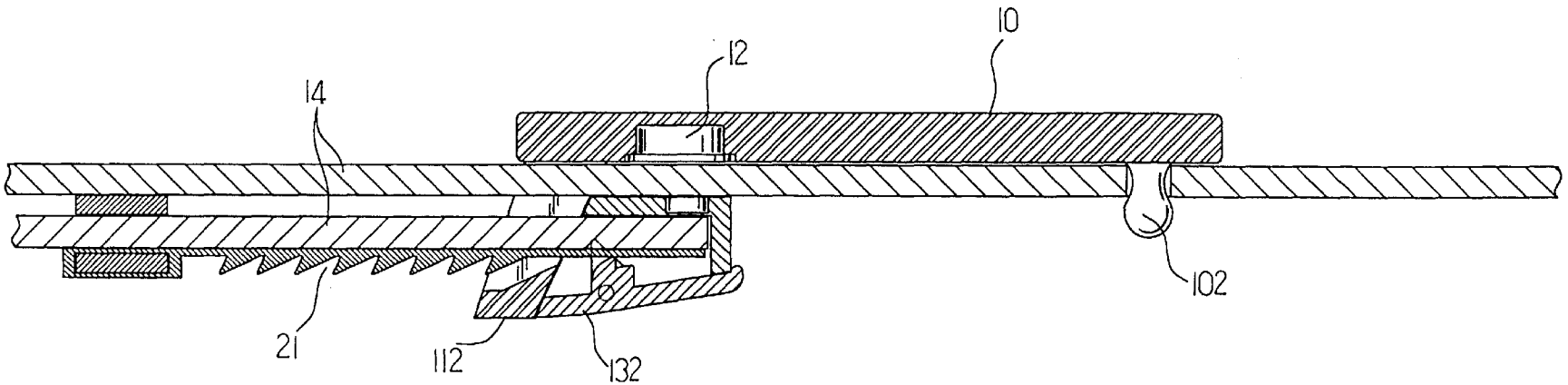
FIG. 5 is a sectional view showing that the other end of the belt is inserted into the present invention.

Referring to FIGS. 4 and 5, alternatively, the short bars 112 at two ends of the micro-adjuster 11 can be extended and inclined. The movable clipping plate 132 of the clip buckle 13 can be disposed in accordance with the inclination of the short bars 112. When micro-adjusted, the movable clipping plate 132 can be moved up and down in accordance with the inclination of the short bars 112 of the micro-adjuster 11. In addition, the short bars 112 are elongated to a certain extent so that a larger receiving space is available for easily and conveniently passing the other end of the belt 14 between the micro-adjuster 11 and the clip buckle 13.

The above embodiments are only used to illustrate the present invention, not intended to limit the scope thereof. Many modifications of the above embodiments can be made without departing from the spirit of the present invention.

What is claimed is:

1. A micro-adjustable belt structure comprising a belt head, a micro-adjusting strap, a micro-adjuster for adjusting the length of the strap, and a clip buckle, said micro-adjustable belt structure being characterized in that a magnet is fixedly disposed at a certain position on the micro-adjuster and a magnetic member is fixedly disposed on the clip buckle corresponding to the magnet, wherein the magnet and the magnetic member attract each other to attach the micro-adjuster and the clip buckle to each other.

2. A micro-adjustable belt structure as claimed in claim 1, wherein the micro-adjuster is formed with a dent for receiving the magnet.

3. A micro-adjustable belt structure as claimed in claim 1, wherein the clip buckle is formed with a dent for receiving the magnetic member.

4. A micro-adjustable belt structure as claimed in claim 3, wherein the magnetic member of the clip buckle is covered by a transparent protective film for protecting the magnetic member from being rusted.

5. A micro-adjustable belt structure as claimed in claim 1, wherein the magnetic member is an iron plate.

6. A micro-adjustable belt structure as claimed in claim 1, wherein the magnetic member is disposed with a hidden trademark.

7. A micro-adjustable belt structure as claimed in claim 1, wherein the clip buckle is made of a non-magnetic material.

* * * * *